US006361007B1

(12) United States Patent
Oby et al.

(10) Patent No.: US 6,361,007 B1
(45) Date of Patent: Mar. 26, 2002

(54) MOUNTING BRACKET FOR PCS AND OTHER ANTENNAS

(75) Inventors: Lawrence R. Oby, Larkspur; Richard Pacheco, Colorado Springs, both of CO (US)

(73) Assignee: Xircom Wireless, Inc., Colorado Springs, CO (US)

( * ) Notice: Subject to any disclaimer, the term of this patent is extended or adjusted under 35 U.S.C. 154(b) by 0 days.

(21) Appl. No.: 09/483,215

(22) Filed: Jan. 14, 2000

(51) Int. Cl.[7] ..... E04G 3/00

(52) U.S. Cl. ..... 248/285.1; 248/286.1; 343/892

(58) Field of Search ..... 248/285.1, 213.1, 248/284.1, 292.14, 291.1, 298.1, 278.1, 279.1, 282.1, 286.1, 287.1; 343/882, 892, 878

(56) References Cited

U.S. PATENT DOCUMENTS 4,931,809 A * 6/1990 Putman et al. ..... 343/882
5,554,998 A * 9/1996 Sherwood et al. ..... 343/881
5,941,497 A * 8/1999 Inoue et al. ..... 248/514
5,963,179 A * 10/1999 Chavez ..... 343/892
6,045,103 A * 4/2000 Costa et al. ..... 248/278.1
6,126,128 A * 10/2000 Costa et al. ..... 248/278

* cited by examiner

*Primary Examiner*—Ramon O. Ramirez
*Assistant Examiner*—A. Joseph Wujciak
(74) *Attorney, Agent, or Firm*—Lyon & Lyon LLP

(57) ABSTRACT

A low profile, multi angle, adjustable mounting bracket that allows an antenna or other device to be secured to a mounting surface and rotated through a substantially 180° arc with minimal protrusion from the mounting surface. A mounting bracket in accordance with the present invention comprises a bracket support and a rotational slide support. The slide support provides two degrees of freedom in its adjustment by allowing both rotation and translation about a single point on the bracket support.

19 Claims, 6 Drawing Sheets

MOUNTING BRACKET FOR PCS AND OTHER ANTENNAS

FIELD OF THE INVENTION

The present invention pertains to mounting brackets including more particularly to low profile mounting brackets for use with antenna systems.

BACKGROUND OF THE INVENTION

Wireless communication systems most often employ the use of "cell" technology, where a base station or other transceiver is dedicated to a specific geographic area. After accessing a base station, wireless customers are then connected to a communications network, such as a publicly switched telephone network (PSTN) or a data network such as a corporate LAN.

To provide complete coverage over an entire metropolitan area or geographic region, base stations must be installed at frequent and regular intervals. The need for such a regular array of base stations often necessitates that they be placed in conspicuous locations.

Since communication base stations require an antenna system to transmit and receive information to a wireless customer, the antenna often needs to be placed where there are no obstructions that will interfere with its operation. Optimizing the antenna performance often requires placing the antenna on the side of a building or on top of a tall pole or mast. Particularly in urban settings, crowded geographic regions, and residential areas, the need to install a large number of base stations and their associated antennas is typically at odds with the desire of a municipality to reduce the clutter and obtrusiveness of industrial installations and unsightly electrical and communications equipment. Local municipalities may have strict zoning regulations which can interfere with or even prohibit a communications company from installing wireless equipment in a location that interferes with the aesthetic characteristics of the city or town. To operate at optimum effectiveness, a direct line of sight between the antenna and the communications device is preferred. This usually requires a conspicuous installation.

Antennas associated with communications systems may sometimes require field adjustments so that the directivity of the antenna can be modified to optimize its performance. New structures, additional base stations, or changing electromagnetic interference can alter the performance of an antenna system, requiring the orientation of an antenna to be changed from time to time. Consequently, it is beneficial to install an antenna so that the orientation of the antenna can be altered quickly and with minimum effort.

Known mounting brackets which can pivot or rotate do not address the need to keep the antenna as inconspicuous as possible. Since these brackets typically only pivot about a fixed point, the distance an antenna projects from its mounting surface is substantially increased. Typically, the larger the pivot angle, the more the antenna projects from the mounting surface. Known mounting brackets which try to reduce their projection distance are restricted in their pivoting range. To enable known mounting brackets to effectively pivot an antenna through a complete 180° arc generally requires that the mounting bracket be extremely bulky and obtrusive. Particularly when an antenna, base station or other communication device is mounted to the side of a building, known mounting brackets can cause the device to protrude significantly from the mounting surface. Even slight increases in this projection distance tends to make the device more noticeable, may result in violations of local zoning regulations, and may ultimately interfere with the ability of a communications company to install the device in the proper location.

When mounting an antenna to the side of a building it is therefore desired to achieve a near flush mounting while still maintaining the ability to aim or direct the antenna across a wide range of angles.

SUMMARY OF THE INVENTION

The present invention solves the foregoing problems by providing a low profile, multi angle, adjustable mounting bracket. Thus, the mounting bracket of the present invention allows an antenna to be secured to a mounting surface and rotated through a substantially 180° arc with minimal protrusion from the mounting surface.

In one aspect of the present invention, the mounting bracket comprises a bracket support and a rotational slide support. The rotational slide support provides two degrees of freedom in its adjustment by allowing both rotation and translation about a single point on the bracket support.

In a preferred embodiment, the mounting bracket comprises a bracket support including a base plate, a bracket wall, and a clampable, pivoting slide mechanism. The preferred mounting bracket also comprises a rotational slide support including a mounting plate, a slide wall, and a channel in the slide wall. Preferably, the clampable, pivoting slide mechanism is engaged within the slide wall channel.

DETAILED DESCRIPTION OF THE PREFERRED EMBODIMENTS

Figure 2:
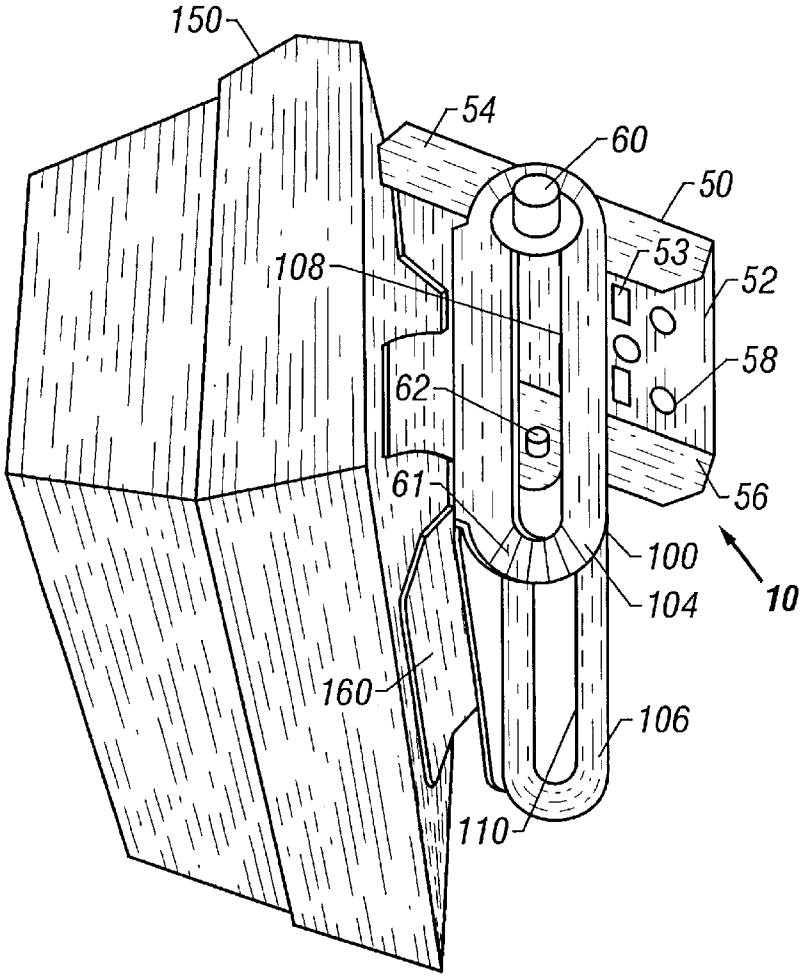
FIG. 2 is the mounting bracket of FIG. 1 shown with an antenna mounted thereon.
Figure 1:
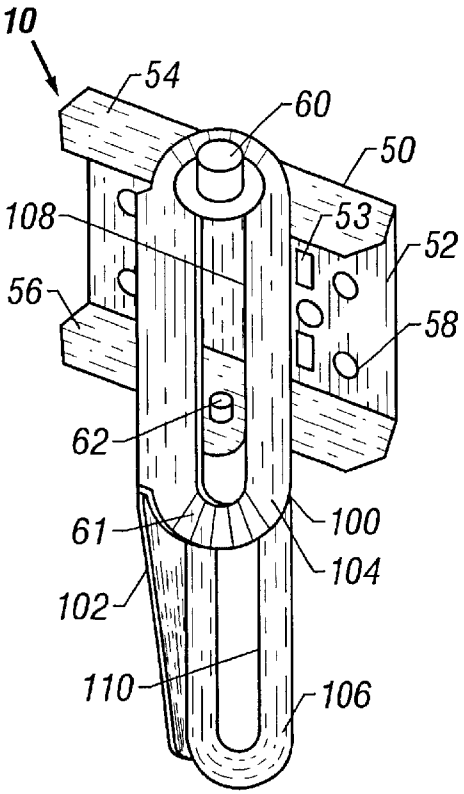
FIG. 1 is a perspective view of a mounting bracket in accordance with the present invention.
Figure 3:
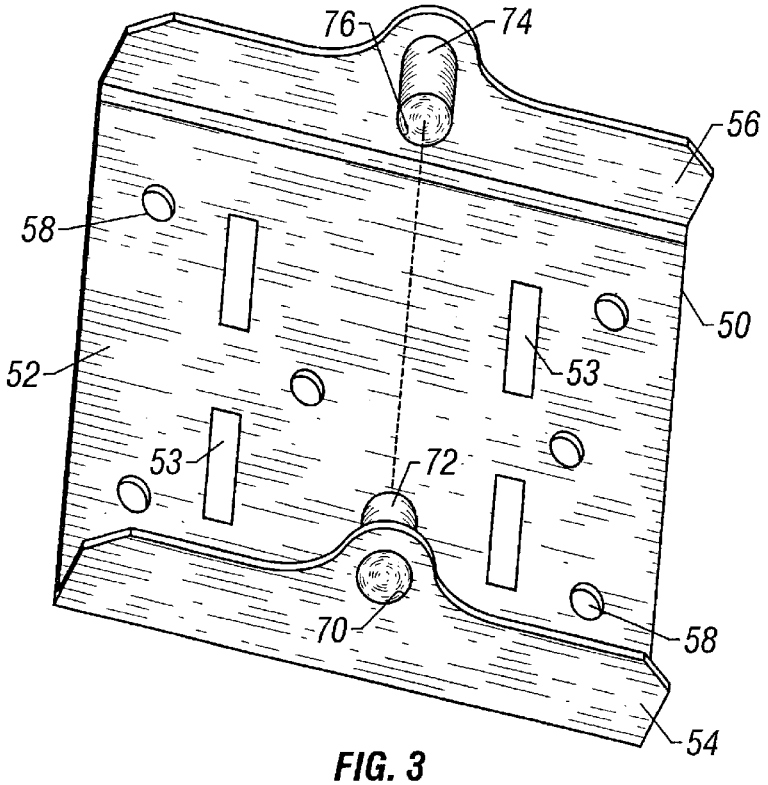
FIG. 3 is a perspective view of a bracket support of a mounting bracket in accordance with the present invention.
Figure 5:
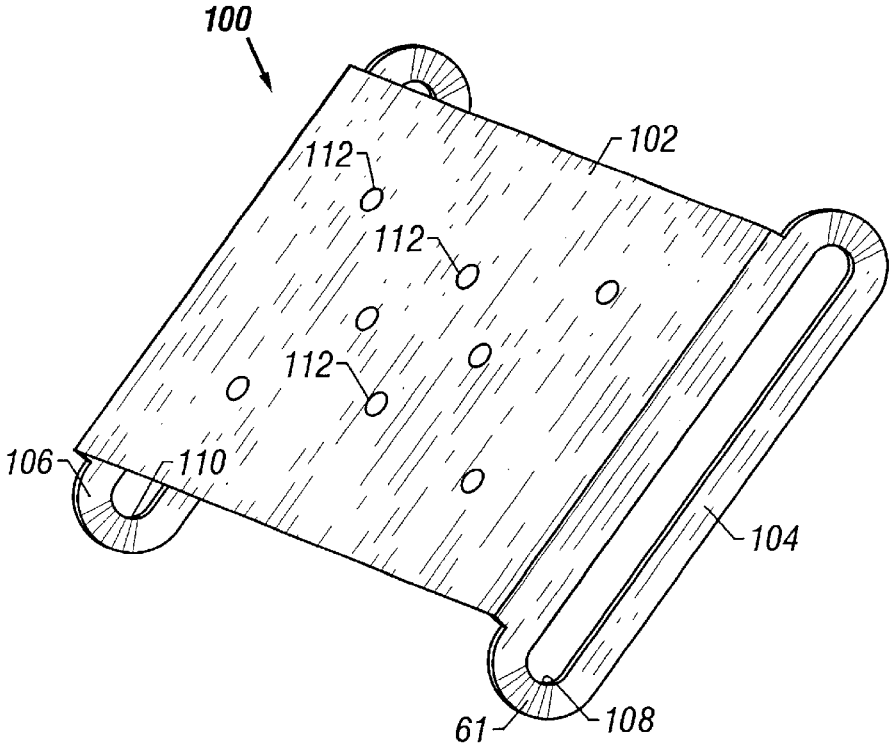
FIG. 5 is a perspective view of a rotational slide support of a mounting bracket in accordance with the present invention.

FIGS. 1–6D show a preferred embodiment of a mounting bracket 10 in accordance with the present invention. The mounting bracket 10 includes a bracket support 50 and a rotational slide support 100. The bracket support 50 is preferably a formed or cast piece, and is preferably made from a metal such as aluminum, or another high strength and lightweight material such as a ceramic, fiberglass, or heavy duty plastic. If the mounting bracket 10 is to be mounted outside, the bracket support 50 should be formed from a material able to withstand extended exposure to extreme environmental conditions such as high and low temperatures, wind, rain, snow, etc. Additionally, the bracket support 50 is preferably made from a material that will not produce electromagnetic interference or otherwise affect the operation of an antenna system. The bracket support 50 preferably includes a substantially flat base plate 52 and at least one bracket wall or a pair of opposing bracket walls 54 and 56 which extend from the base plate 52. Preferably, the bracket walls are mounted to be substantially perpendicular to the base plate. If a pair of bracket walls are utilized, the bracket walls are preferably substantially parallel to each other. The bracket walls 54 and 56 also preferably include a pair of extensions 72 and 74 (shown in FIG. 3). In an embodiment with a single bracket wall, only one extension is required. Preferably the extensions 72 and 74 have a cylindrical shape and include apertures 70 and 76 through which a pivot device 62 is engaged. The pivot device 62 may be a nut and bolt combination or alternately the extensions 72 and 74 may be threaded and adapted to receive a bolt. The pivot device 62, together with the extensions 72 and 74, and apertures 70 and 76, form a clampable, pivoting slide mechanism 60. Such an arrangement allows the rotational slide support 100 when engaged with the bracket support 50, to slide in a linear direction, and to rotate about the pivot device 62. The clampable pivoting slide mechanism 60 is preferably capable of being tightened in order to secure the rotational slide support 100 to the bracket support 50 once the rotational slide support 100 is engaged with the bracket support 50 and it is in its desired position.

Figure 4C:
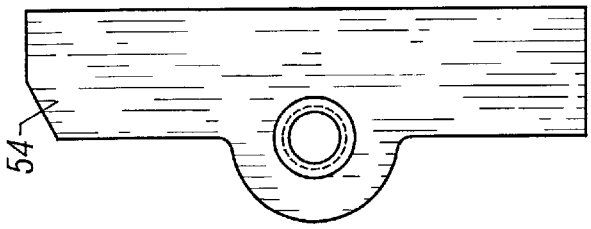
FIG. 4C is a right side elevation view of the bracket support of FIG. 3.
Figure 4A:
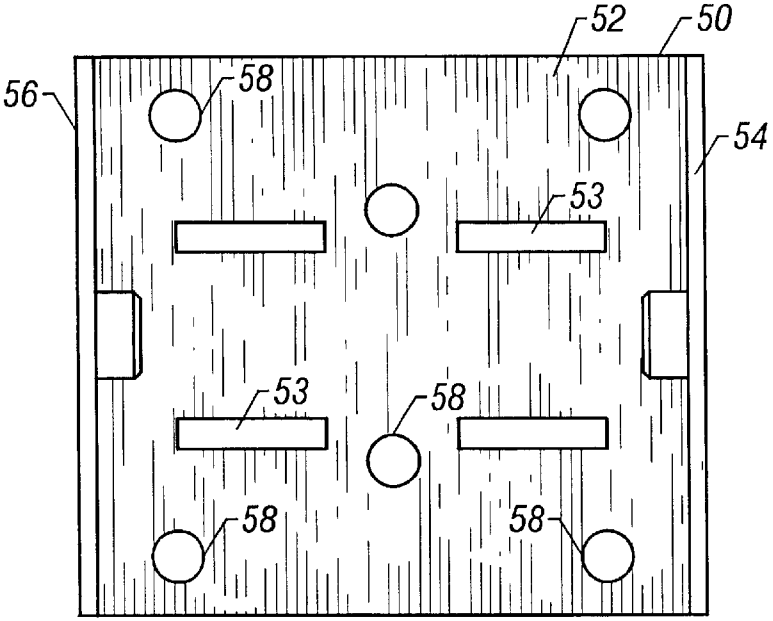
FIG. 4A is a plan view of the bracket support of FIG. 3.
Figure 4B:
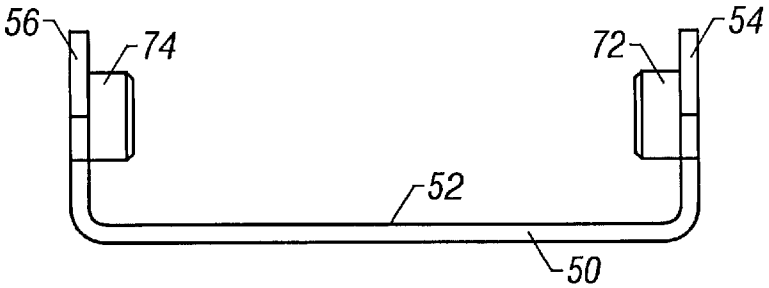
FIG. 4B is a front elevation view of the bracket support of FIG. 3.
Figure 4D:
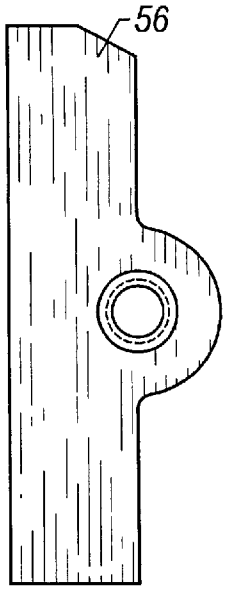
FIG. 4D is a left side elevation view of the bracket support of FIG. 3.

Preferably, the base plate 52 includes at least one aperture 58, which is adapted to receive a screw, bolt, rivet or other fastening device. Each of the apertures 58 allow the bracket support 50 to be firmly attached to a mounting surface such as the side of a building, the top of a pole or mast, or any other solid surface. Preferably, an array of apertures 58 are provided in the base plate 52 to further ensure a secure attachment of the bracket support 50 to the mounting surface. Preferably, as shown in FIG. 4A, up to six screws, bolts, etc. can be used to attach the base plate 52 to a mounting surface. Slots 53 are also preferably provided in base plate 52 so that straps can alternatively be used to attach the base plate 52 to a non-planar surface, such as the side of a pole or round mast that is not suitable for use with screws, bolts, etc. Mounting larger and heavier antennas to the mounting bracket 10 may necessitate additional mounting points. When secured to a mounting surface 170, the bracket support 50 is preferably fixed in position and does not move. When the rotational slide support 100 is attached to the bracket support, it is also secured in place.

The rotational slide support 100 is also preferably a formed or cast piece, preferably made from a similar material to that of the bracket support 50. The rotational slide support 100 preferably includes a mounting plate 102 and at least one slide wall or a pair of opposing slide walls 104 and 106 which extend from the mounting plate 102. Preferably, the slide walls are mounted to be substantially perpendicular to the mounting plate 102. If a pair of slide walls are used, they are preferably substantially parallel to each other. Each of the slide walls 104 and 106 include similarly shaped elongate channels 108 and 110. The channels 108 and 110 are adapted to engage with the clampable, pivoting slide mechanism 60 on the bracket support 50. Thus, the width of the channels 108 and 110 are such that the clampable pivoting side mechanism 60 will engage in the channels 108 and 110, while simultaneously allowing the rotational slide support 100 to move linearly as well as rotate about the clampable pivoting slide mechanism 60. The clampable pivoting slide mechanism 60 serves as a pivot point for the rotational slide plate 100. This arrangement allows the pivot point of the rotational slide plate 100 to be selectively at any position along the length of the channels 108 and 110.

In this manner, the mounting plate 102 of the rotational slide support 100 can be positioned so that it faces any direction through an approximately 180° azimuth. Once the rotational slide support 100 is in a desired position, the clampable pivoting slide mechanism 60 can be tightened to fix the rotational slide support 100 in that position. Adjustments to the position of the rotational slide support 100 can be made by loosening the clampable pivoting slide mechanism 60, repositioning the rotational slide support 100 and re-tightening the clampable pivoting slide mechanism 60. Repositioning of the rotational slide support 100 may involve both moving the rotational slide support 100 in a linear direction, as well as rotating the rotational slide support 100 about the pivot device 62.

Figure 6B:
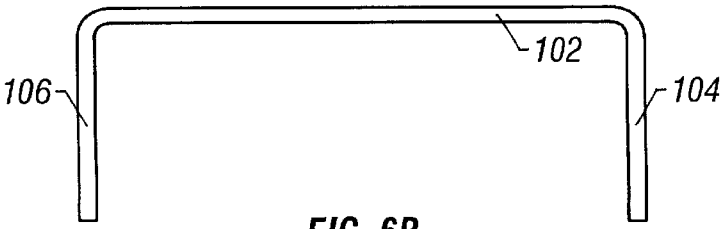
FIG. 6B is a front elevation view of the rotational slide support of FIG. 5.
Figure 6A:
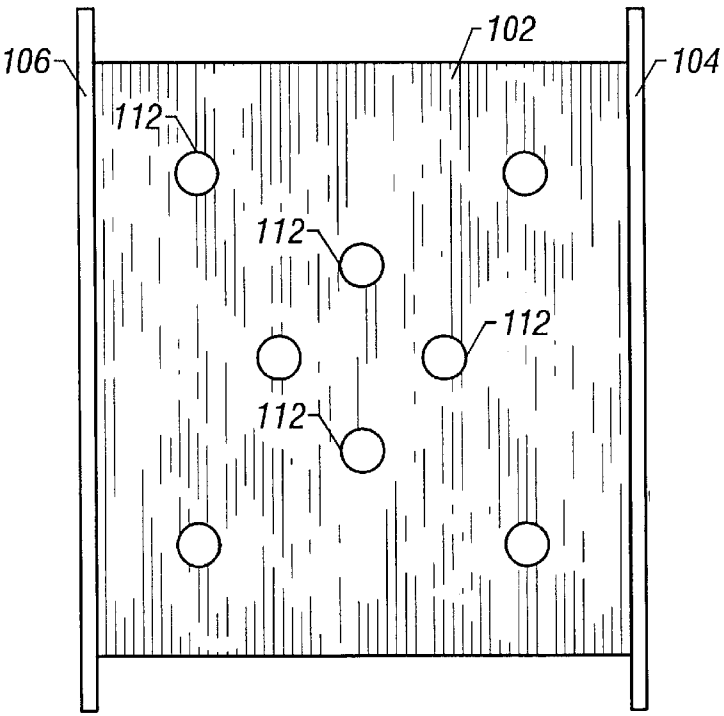
FIG. 6A is a plan view of the rotational slide support of FIG. 5.
Figure 6C:
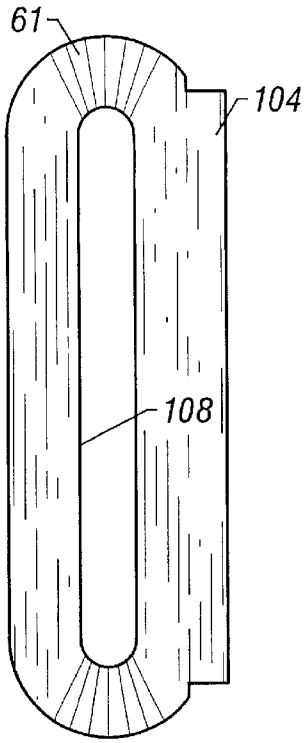
FIG. 6C is a right side elevation view of the rotational slide support of FIG. 5.
Figure 6D:
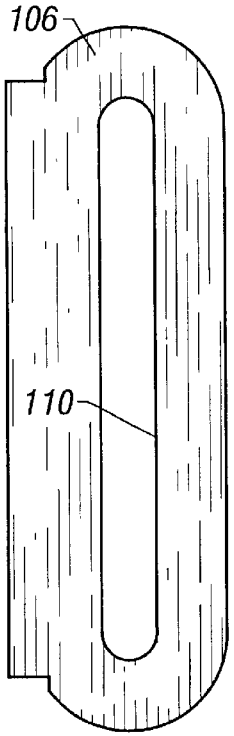
FIG. 6D is a left side elevation view of the rotational slide support of FIG. 5.

Preferably, at least one aperture 112 is provided in the mounting plate 102. Each of the apertures 112 are preferably adapted to receive a screw, bolt, or other fastening device. The apertures 112 allow an antenna or other device to be secured to the mounting plate 102. Preferably, an array of apertures 112 are provided to further ensure that an antenna or other device can be securely connected to the mounting plate. Preferably, as shown in FIG. 6A, up to eight screws, bolts, or other fastening devices can be used to attach an antenna or other device to the mounting plate 102. The rotational slide support 100 also includes a visual scale 61 that allows more precise adjustment to the rotation angle of the rotational slide support 100.

FIG. 2 shows the mounting bracket 10 with an antenna 150 mounted to the rotational slide support 100. The antenna 150 may be a PCS antenna or an antenna for another type of communication device, radio module, base station or other antenna based system. The mounting bracket 10 of the present invention can be used with any device that needs to be flush mounted and also requires the flexibility of directional adjustment. For example, devices such as base stations and radio modules may also utilize a mounting bracket in accordance with the present invention. Examples of such base stations are described in copending U.S. patent application Ser. Nos. 09/316,457 and 09/316,459 as well as Ser. No. 09/460,624, the details of which are hereby incorporated by reference.

The antenna 150 may alternately include a separate mounting flange 160 connected directly to the undersurface of the antenna 150 (See FIG. 2). In such a configuration, the mounting flange 160 is secured to the mounting plate 102 of the rotational slide support via the apertures 112. The mounting flange 160 is not necessary and the antenna 150 may alternately be clamped, bolted, welded or otherwise secured directly to the mounting plate 102.

Figure 7C:
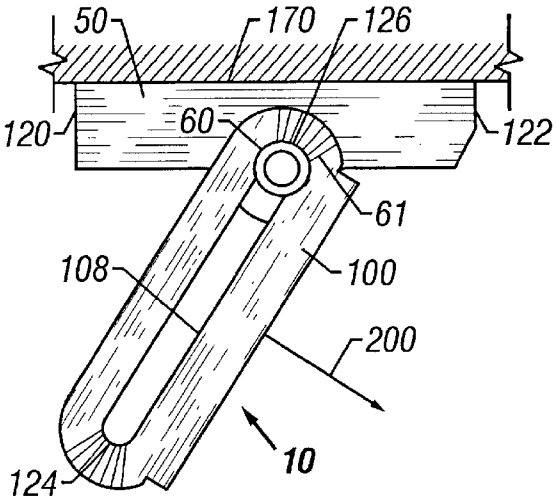
FIGS. 7A–7C are side views of a mounting bracket in accordance with the present invention shown at three different angles of rotation.
Figure 7B:
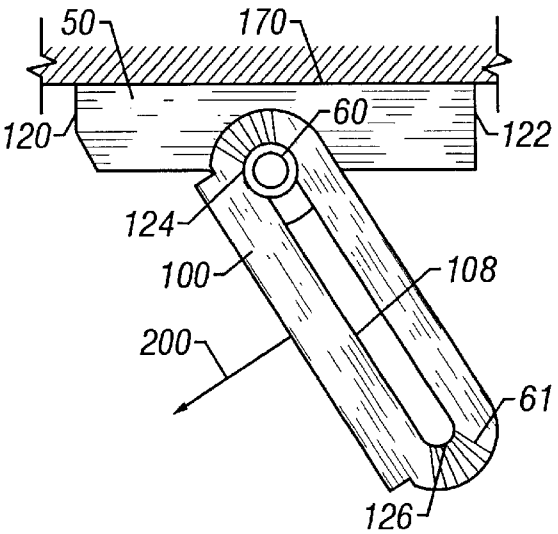
Figure 7A:
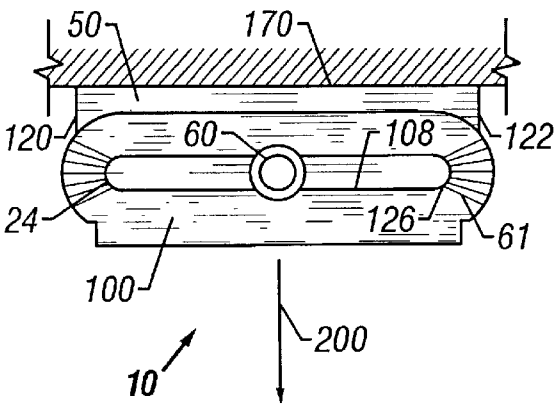

FIGS. 7A through 7C further illustrate the variable positioning of a mounting bracket 10 in accordance with the present invention. For purposes of illustration and description, in each of FIGS. 7A–7C, the mounting bracket 10 is shown as if horizontally mounted on the side of a building or other wall. FIGS. 7A–7C are top views of the mounting bracket 10. In each position shown in FIGS. 7A–7C, the bracket support 50 is securely attached to a mounting surface 170, while the rotational slide support 100 is moved within the channels 108 and 110 and rotated about the pivot device 62 of the clampable pivoting slide mechanism 60.

FIG. 7A shows the rotational slide support 100 in a first position, where the surface of the mounting plate 102 points in a direction essentially perpendicular to the bracket support 50 and the mounting surface 170. Arrow 200 shows the direction that mounting plate 102 faces and the direction that an attached antenna would point. In this position, the clampable, pivoting slide mechanism 60 is approximately at the midpoint of the slots 108 and 110.

FIG. 7B shows the rotational slide support 100 in a second position, where the surface of the mounting plate 102 points toward a first end 120 of the bracket support 50. Arrow 200 shows the direction that mounting plate 102 faces and the direction that a corresponding antenna would point. In this position, the clampable, pivoting slide mechanism 60 is located toward a first end 124 of the channels 108 and 110 and the rotational slide support 100 is rotated clockwise to achieve the desired directivity of the mounting plate 102 and any device that may be attached to it.

FIG. 7C shows the rotational slide support 100 in a third position, where the surface of the mounting plate 102 points toward a second end 122 of the bracket support 50. Arrow 200 shows the direction that mounting plate 102 faces and the direction that a corresponding antenna would point. In this position, the clampable, pivoting slide mechanism 60 is located toward a second end 126 of the channels 108 and 110 and the rotational slide support 100 is rotated counterclockwise to achieve the desired directivity of the mounting plate 102 and any device that may be attached to it.

Since the mounting bracket 50, and more particularly the clampable, pivoting slide mechanism 60, can maintain any linear position within the channels 108 and 110, while at the same time the rotational slide support 100 can be rotated about the clampable, pivoting slide mechanism 60 to any angular position, the mounting plate 102 of the rotational slide support 100 can be rotated to most positions within an 180° arc, while simultaneously maintaining a minimal protrusion from the mounting surface 170.

Figure 8A:
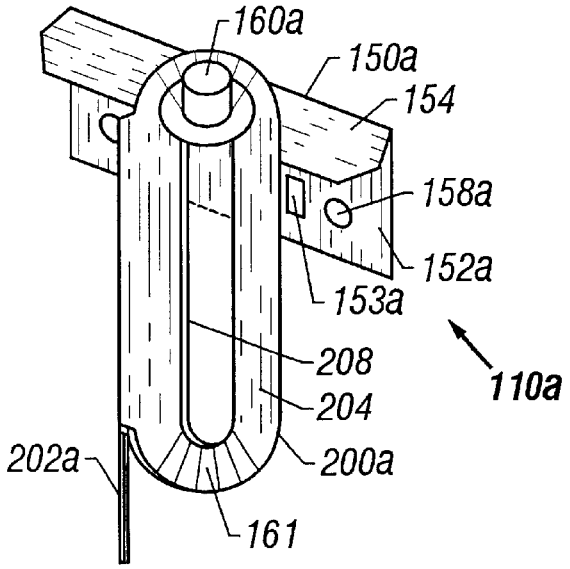
FIG. 8 is an alternate embodiment of a mounting bracket in accordance with the present invention.
Figure 8B:
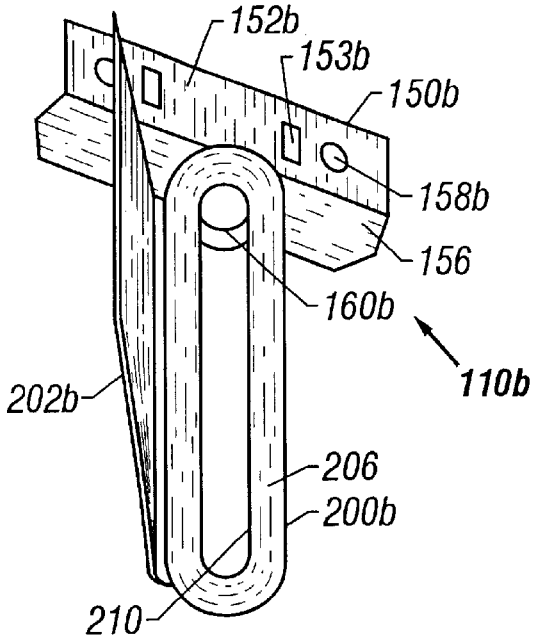

FIG. 8 shows an alternate embodiment of a mounting bracket in accordance with the present invention. In FIG. 8, each of the mounting brackets 110*a* and 110*b* are effectively half of the previously described embodiments of the mounting bracket 10. Mounting bracket 110*a* has a bracket support 150*a*, which includes a bracket wall 154 and a base plate 152*a*. The bracket wall 154 and the base plate 152*a* are preferably arranged in a similar manner as the mounting bracket 10 described above. Attached to the bracket wall 154 is a clampable pivoting slide mechanism 160*a* similar to the clampable pivoting slide mechanism 60 described above. Included on the base plate 152*a* are apertures 158*a* and 153*a* which allow the mounting bracket 110*a* to be secured to a mounting surface such as a wall or pole. The mounting bracket 110*a* also includes a rotational slide support 200*a*, which includes a mounting plate 202*a* and a slide wall 204. The slide wall 204 includes a channel 208 that engages with the clampable pivoting slide mechanism 160*a*. A visual or tactile scale 161 is included on an end of the slide wall 204 to allow more precise positioning of the rotational slide support 200*a*.

FIG. 8 also shows a second mounting bracket 110*b*. Mounting bracket 110*b* has a bracket support 150*b*, which includes a bracket wall 156 and a base plate 152*b*. The bracket wall 156 and the base plate 152*b* are preferably arranged in a similar manner as the mounting bracket 10 described above. Attached to the bracket wall 156 is a clampable pivoting slide mechanism 160*b* similar to the clampable pivoting slide mechanism 60 described above. Included on the base plate 152*b* are apertures 158*b* and 153*b* which allow the mounting bracket 110*b* to be secured to a mounting surface such as a wall or pole. The mounting bracket 110*b* also includes a rotational slide support 200*b*, which includes a mounting plate 202*b* and a slide wall 206. The slide wall 206 includes a channel 210 that engages with the clampable pivoting slide mechanism 160*b*. A visual or tactile scale 161 (not shown) is included on an end of the slide wall 206 to allow more precise positioning of the rotational slide support 200*b*.

The mounting brackets 110*a* and 110*b* can be used independently of each other or in conjunction with each other. The combination of mounting brackets 110*a* and 110*b* are preferably used when a large device needs to be mounted to the mounting plates 202*a* and 202*b*. In this manner, less material is needed to construct the mounting brackets resulting in a reduced cost.

A mounting bracket in accordance with the present invention can also be used in conjunction with other mounting brackets. For example, the mounting bracket of the present invention can be used in conjunction with an adjustable mount as more fully described in Ser. No. 09/483,198, the details of which are incorporated by reference into the present disclosure.

Although the invention has been described and illustrated in the above description and drawings, it is understood that this description is by example only and that different embodiments may be made without departing from the true spirit and scope of the invention. The invention therefore should not be restricted, except within the spirit and scope of the following claims.

What is claimed is:

1. A mounting bracket comprising:

a bracket support, said bracket support comprising
- a base plate; and
- at least one bracket wall extending from said base plate;

a rotational slide support comprising
- a mounting plate;
- at least one slide wall extending from said mounting plate; and
- a channel in each said slide wall; and a clampable, pivoting, slide mechanism attached to said bracket wall and engaging each said channel.

2. The mounting bracket of claim 1, wherein said bracket support comprises a pair of opposing bracket walls extending from said base plate, and wherein said rotational slide support comprises a pair of opposing slide walls extending from said mounting plate.

3. The mounting bracket of claim 2, wherein said clampable, pivoting, slide mechanisms are opposing each other.

4. The mounting bracket of claim 2, wherein said base plate has a first surface and a second surface, and wherein said opposing bracket walls extend from said first surface of said base plate, wherein said mounting plate has a first surface and a second surface and wherein said opposing slide walls extend from said second surface of said mounting plate.

5. The mounting bracket of claim 1 further comprising at least one aperture in said base plate and at least one aperture in said mounting plate.

6. The mounting bracket of claim 1, wherein said at least one bracket wall is proximate to the periphery of said base plate.

7. The mounting bracket of claim 2, wherein said bracket walls are proximate to the periphery of said base plate and said bracket walls are substantially parallel to each other.

8. The mounting bracket of claim 1, wherein said clampable, pivoting, slide mechanism comprises a threaded bolt and a nut.

9. The mounting bracket of claim 1, wherein said clampable, pivoting, slide mechanism comprises a bolt and a cotter pin.

10. The mounting bracket of claim 1, wherein said clampable, pivoting, slide mechanism comprises a clamp.

11. The mounting bracket of claim 1, wherein said bracket support and said rotational slide support are formed from aluminum.

12. The mounting bracket of claim 1, wherein said bracket support and said rotational slide support are formed from galvanized steel.

13. The mounting bracket of claim 1, wherein said bracket support and said rotational slide support are formed from a thermoplastic resin.

14. A mounting bracket comprising:

a U-shaped bracket support having a base plate, a first bracket wall and a second bracket wall;

a first clampable, pivoting, slide mechanism attached to said first bracket wall and a second clampable, pivoting, slide mechanism attached to said second bracket wall;

a U-shaped rotational slide support having a mounting plate, a first slide wall and a second slide wall; and a first channel in said first slide wall and a second channel in said second slide wall;

wherein said first and second clampable, pivoting, slide mechanisms are engaged in said first and second channels.

15. The mounting bracket of claim 14, wherein said first and said second bracket walls are opposing each other and are substantially parallel, and wherein said first and second slide walls are opposing each other and are substantially parallel.

16. The mounting bracket of claim 14, wherein said U-shaped bracket support is adapted to mount to a surface.

17. A mounting bracket comprising:

a first L-shaped bracket support having a first base plate and a first bracket wall;

a first clampable, pivoting, slide mechanism attached to said first bracket wall; and a first L-shaped rotational slide support having a first mounting plate and a first slide wall, said first slide wall including a first channel;

wherein said first clampable, pivoting, slide mechanism is engaged in said first channel.

18. The mounting bracket of claim 17, further comprising:

a second L-shaped bracket support having a second base plate and a second bracket wall;

a second clampable, pivoting, slide mechanism attached to said second bracket wall; and a second L-shaped rotational slide support having a second mounting plate and a second slide wall, said second slide wall including a second channel;

wherein said second clampable, pivoting, slide mechanism is engaged in said second channel.

19. The mounting bracket of claim 18, wherein said first and said second base plates are adapted to mount to a surface.

* * * * *